United States Patent [19]

Goldstein et al.

[11] Patent Number: 4,606,889

[45] Date of Patent: Aug. 19, 1986

[54] COPPER-TITANIUM-BERYLLIUM ALLOY

[75] Inventors: Sherwood Goldstein, Reading; Paul J. Scherbner, deceased, late of Boyertown, both of Pa., by Lillian Scherbner, executrix

[73] Assignee: Cabot Corporation, Boston, Mass.

[21] Appl. No.: 795,806

[22] Filed: Nov. 7, 1985

[51] Int. Cl.[4] ..... C22C 9/00

[52] U.S. Cl. ..... 420/492; 420/494; 420/495; 148/411

[58] Field of Search ..... 420/492, 494, 495

[56] References Cited

U.S. PATENT DOCUMENTS

| | | | |
|---|---|---|---|
| 2,030,921 | 2/1936 | Hessenbruck | 420/492 |
| 2,250,850 | 7/1941 | Adamoli | 420/494 |
| 3,201,234 | 8/1965 | Scherbner et al. | 420/494 |

FOREIGN PATENT DOCUMENTS

| | | | |
|---|---|---|---|
| 59-145749 | 8/1984 | Japan | 420/473 |
| 954796 | 4/1964 | United Kingdom | 420/492 |

*Primary Examiner*—Veronica O'Keefe

*Attorney, Agent, or Firm*—Joseph J. Phillips; Jack Schuman

[57] ABSTRACT

Disclosed is a moderate electrical conductivity copper alloy containing titanium and beryllium wherein the ratio of titanium to beryllium is about 10:1. The alloy has an outstanding combination of useful engineering properties: mechanical strength, physical characteristics and good fabricability. A typical alloy contains, in weight percent, about 2.3 titanium, 0.2 beryllium and the balance copper plus normal impurities found in alloys of this class.

6 Claims, No Drawings

COPPER-TITANIUM-BERYLLIUM ALLOY

This invention relates to age-hardenable copper alloys and, more specifically, to an alloy specifically alloyed to provide improved mechanical properties.

Copper-beryllium alloys have been known in the art for decades. These alloys generally contain an effective amount of cobalt. There have been many improvements and modifications of this alloy system, because of its many desirable engineering characteristics.

Copper-titanium alloys are also known in the art. These alloys generally contain about 2 to 6 percent titanium and are marketed expecially in the Japanese automotive, appliance and electronic markets.

Copper-titanium alloys are used essentially in similar applications as copper-beryllium alloys.

CuBe and CuTi alloys are readily produced and, in general, have good electrical conductivity, tensile strength and hardness. Improvements and modifications of these alloy systems usually result in more desirable properties in one or more characteristics. At times, the improvement of one characteristic is made at a loss of another characteristic. For example, alloying to improve hardness may result in lower electrical conductivity. The art is in constant need of an alloy that provides a desirable combination of useful properties.

As indicated above, the CuBe and CuTi alloys have been well-known in the art for many years. There have been several references to copper alloys containing both beryllium and titanium, often as optional elements, as impurities, or included in complex alloys also requiring effective contents of chromium, vanadium, nickel, cobalt and the like. U.S. Pat. No. 2,030,921 relates to a copper alloy containing a wide range of beryllium and titanium to obtain high hardness properties in the alloy. U.S. Pat. No. 3,201,234 discloses copper alloys containing cobalt, titanium, beryllium, and other required elements. U.S. Pat. No. 2,250,850 discloses a CuBe alloy containing several "ternary" elements including 0.1 to 0.5 Ti.

The teachings in the prior art patents disclose many interesting experimental alloys, but none of the ternary alloys (CuTiBe) have become economical marketable products.

It is the principal object of this invention to provide a moderate conductivity copper alloy with an optimum combination of mechanical properties, such as resistance to stress relaxation with good tensile properties and formability.

Other objects of this invention may be discerned by those skilled in the art from the alloy of this invention as disclosed in Table I.

Table I presents the ranges of composition that define various embodiments of the alloy of this invention. The Broad range in Table I defines the scope wherein some advantage of the invention may be obtained under certain circumstances.

TABLE I

| | ALLOYS OF THIS INVENTION Composition in Weight Percent | | | | |
|---|---|---|---|---|---|
| ELEMENT | BROAD RANGE | PREFERRED RANGE | TYPICAL RANGE | TYPICAL ALLOY II | TYPICAL ALLOY III |
| Titanium | 1.5 to 5.5 | 1.5 to 3.5 | 1.65 to 2.5 | About 1.9 | About 2.3 |
| Beryllium | 0.1 to 0.7 | 0.10 to 0.50 | 0.15 to 0.25 | About 0.19 | About 0.2 |
| Aluminum & Magnesium | Up to 0.75 | Up to 0.75 | Up to 0.50 | — | — |
| Cobalt + Nickel | Up to 0.50 | Up to 0.50 | Up to 0.50 | — | — |
| Total Fe, Si, Sn, Ca, Pb, Cr, Zn, Mn | Up to 0.70 | Up to 0.70 | Up to 0.5 | — | — |
| Copper plus Impurities | Balance | Balance | Balance | Balance | Balance |
| Ti:Be | 5 to 20:1 | 8 to 17:1 | 8 to 17:1 | About 10:1 | About 10:1 |

The preferred range in Table I defines the scope wherein a higher degree of advantages may be obtained. Data show that many properties are improved with compositions within this range.

The Typical alloys defined in Table I are two especially useful embodiments of the invention. The typical alloys have an effective working scope essentially as defined in the Typical Range as shown in Table I.

The compositions in Table I contain "copper plus impurities" as balance. In the production of copper alloys of this class, impurities from many sources are found in the final product. These so-called "impurities" are not necessarily always harmful and some may actually be beneficial or have an innocuous effect, for example, cobalt and aluminum.

Some of the "impurities" may be present as residual elements resulting from certain processing steps, or be adventitiously present in the charge materials; for example, silicon, iron, manganese, sodium, lithium, calcium, magnesium, vanadium, zinc and zirconium.

In actual practice, certain impurity elements are kept within established limits with a maximum and/or minimum to obtain uniform products as is well-known in the art and skill of melting and processing these alloys. Sodium, lithium, calcium, and zinc must generally be kept at low levels.

Thus, the alloy of this invention may contain these and other impurities within the limits usually associated with alloys of this class, and as recited in commercial specifications.

Although the exact mechanism of the invention is not completely understood, it is believed that the required control of the titanium to beryllium ratio provides the proper balance of metallurgical phases that is essential to obtain the best combination of properties.

Table II presents specific compositions of the alloys of this invention that were prepared for experimental tests. Each alloy contains copper, impurities and other elements as defined in the broad range in Table I.

The experimental alloys were prepared by a variety of methods as will be disclosed. The alloys may be readily produced by methods known in this art.

EXAMPLE I

Alloy I was direct chill cast as a $3\frac{1}{4}\times9\frac{1}{2}$ inch billet and cut to $\frac{3}{8}$ inch thick wafers ($3\frac{1}{4}\times9\frac{1}{2}$ inch cross section). The wafers were homogenized in argon atmosphere at 1650° F. for two hours and water quenched. The wafers were then milled to 0.200 inch thickness and cold rolled to 0.012 inch. The cold-rolled samples were solution treated to 1450° F. for 5 minutes and water quenched. Then, finally cold rolled to 0.010 inch before aging.

Table III presents data obtained from Alloy I cold worked 10% and 15%.

TABLE II

EXPERIMENTAL ALLOYS OF THIS INVENTION
Composition in Weight Percent

| | Ti | Be | Cu* |
|---|---|---|---|
| Alloy I | 1.6 | 0.14 | Bal. |
| Alloy II | 1.9 | 0.19 | Bal. |
| Alloy III | 2.3 | 0.21 | Bal. |
| Alloy IV | 3.0 | 0.40 | Bal. |
| Alloy V | 5.0 | 0.42 | Bal. |

*Cu Plus Impurities

TABLE III

Mechanical Properties Data

| Aging Heat Treatment | UTS (ksi) | YS** (ksi) | EL % | IACS % | 180° Bend R/T T | 180° Bend R/T L |
|---|---|---|---|---|---|---|
| Alloy I (Cu-1.6 Ti-0.14 Be) 10% Cold Work | | | | | | |
| 700° F./15 min | 82.9 | 65.7 | 16.8 | 9.7 | 0.5* | 0.5* |
| 700° F./1 hr | 87.5 | 69.2 | 18.8 | 11.5 | 0.5* | 0.5* |
| 700° F./5 hr | 94.7 | 78.4 | 14.8 | 13.3 | 0.5* | 0.5* |
| 800° F./15 min | 100.6 | 82.5 | 14.0 | 13.2 | 0.5* | 0.5* |
| 800° F./1 hr | 108.1 | 91.3 | 14.8 | 15.8 | 0.5* | 0.7 |
| 800° F./5 hr | 112.5 | 96.3 | 13.5 | 17.9 | 0.4* | 1.3 |
| 900° F./15 min | 104.6 | 87.6 | 11.8 | 15.2 | 0.4* | 1.4 |
| 900° F./1 hr | 105.8 | 88.9 | 12.0 | 16.7 | 0.4* | 1.4 |
| 900° F./5 hr | 98.6 | 81.9 | 10.0 | 18.4 | 0.9 | 1.9 |
| Alloy I (Cu-1.6 Ti-0.14 Be) 15% Cold Work | | | | | | |
| 700° F./15 min | 85.4 | 72.9 | 12.5 | 9.9 | 0.5* | 0.5* |
| 700° F./1 hr | 91.6 | 77.6 | 13.3 | 11.6 | 0.5* | 0.6 |
| 700° F./5 hr | 101.6 | 87.7 | 15.5 | 13.6 | 0.9 | 0.9 |
| 800° F./15 min | 103.5 | 88.3 | 16.0 | 13.5 | 0.5* | 0.6 |
| 800° F./1 hr | 108.6 | 93.3 | 12.5 | 16.1 | 0.5* | 0.9 |
| 800° F./5 hr | 114.3 | 98.6 | 11.8 | 18.0 | 0.5* | 1.3 |
| 900° F./15 min | 107.1 | 91.2 | 13.0 | 15.5 | 0.5* | 0.8 |
| 900° F./1 hr | 105.8 | 90.8 | 10.3 | 16.8 | 0.6* | 1.6 |
| 900° F./5 hr | 100.1 | 84.0 | 9.0 | 18.8 | 0.9 | 1.8 |

*Smallest radius available
To convert from ksi to MPa, multiply by 6.89.
**Yield stress determined at 0.2% offset.

EXAMPLE II

Alloy II was produced as described in Example I. The aging parameters are given in Table IV. Table IV presents mechanical properties of Alloy II cold worked 10% and 15%.

EXAMPLE III

Alloy III was produced as described in Example I. The alloy contained 2.3% Ti, 0.21% Be, balance Cu. Table V presents mechanical properties of Alloy III cold rolled 10% and 15%.

To demonstrate improved formability, Alloy III is compared with commercial Japanese Cu-3Ti alloys. Table VI lists advertised properties and our laboratory evaluation of two different samples of mill hardened CuTi. For the same strength level it can be seen that Alloy III exhibits substantially better formability than CuTi.

EXAMPLE IV

Alloy IV (Cu-3Ti-0.4Be) was cast $3\frac{1}{4}$ inch thick, homogenized 20 hours at 1450° F. and hot rolled to $2\frac{1}{8}$ inch thick slab. The ends were cropped and the slab was reheated to 1550° F. and hot rolled to 0.310 inch thick plate, then bulk annealed and conditioned. The plates were then cold rolled from 0.250 inch to 0.012 inch sheet and strand annealed. The sheets were finally cold rolled from 0.012 to 0.010 inch and aged before testing as shown in Table VII.

TABLE IV

Mechanical Properties Data
Alloy II (Cu-1.9 Ti-0.19 Be)

| Heat Treatment | UTS (ksi) | YS (ksi) | EL % | IACS % | 180° Bend R/T T | 180° Bend R/T L |
|---|---|---|---|---|---|---|
| 10% Cold Work | | | | | | |
| 700° F./15 min | 84.3 | 67.4 | 21.0 | 9.0 | 0.4 | 0.8 |
| 700° F./1 hr | 91.6 | 72.6 | 19.3 | 10.0 | 0.4 | 0.7 |
| 700° F./5 hr | 102.0 | 84.0 | 18.3 | 11.9 | 0.4 | 0.4 |
| 800° F./15 min | 108.6 | 94.1 | 15.5 | 11.7 | 0.7 | 1.1 |
| 800° F./1 hr | 118.4 | 102.5 | 12.0 | 13.8 | 0.7 | 1.3 |
| 800° F./5 hr | 123.0 | 107.6 | 10.5 | 15.8 | 0.7 | 1.8 |
| 900° F./15 min | 113.4 | 98.8 | 11.5 | 13.7 | 0.7 | 1.6 |
| 900° F./1 hr | 113.9 | 96.6 | 12.5 | 14.9 | 0.8 | 5.1 |
| 900° F./5 hr | 100.3 | 86.0 | 12.0 | 16.8 | 0.9 | 2.1 |
| 15% Cold Work | | | | | | |
| 700° F./15 min | 89.1 | 74.3 | 15.0 | 8.9 | 0.5 | 0.5 |
| 700° F./1 hr | 96.8 | 82.1 | 15.8 | 10.1 | 0.5 | 0.5 |
| 700° F./5 hr | 109.2 | 96.0 | 14.0 | 12.0 | 0.4 | 0.9 |
| 800° F./15 min | 115.6 | 102.0 | 11.8 | 12.1 | 0.4 | 1.7 |
| 800° F./1 hr | 123.0 | 108.7 | 10.3 | 14.1 | 0.4 | 1.4 |
| 800° F./5 hr | 125.7 | 112.7 | 9.3 | 15.8 | 0.9 | 1.9 |
| 900° F./15 min | 120.1 | 105.2 | 9.3 | 14.4 | 0.6 | 1.8 |
| 900° F./1 hr | 117.8 | 102.1 | 9.8 | 15.7 | 0.8 | 2.0 |
| 900° F./5 hr | 108.6 | 89.7 | 8.5 | 17.9 | 0.8 | 2.2 |

TABLE V

Mechanical Properties Data
Alloy III (Cu-2.3 Ti-0.21 Be)

| Heat Treatment | UTS (ksi) | YS (ksi) | EL % | IACS % | 180° Bend R/T T | 180° Bend R/T L |
|---|---|---|---|---|---|---|
| 10% Cold Work | | | | | | |
| 700° F./15 min | 108.4 | 94.4 | 15.0 | 7.9 | 0.5 | 0.9 |
| 700° F./1 hr | 113.8 | 100.6 | 12.5 | 9.1 | 0.7 | 1.0 |
| 700° F./5 hr | 127.9 | 115.5 | 10.3 | 10.8 | 0.7 | 1.6 |
| 800° F./15 min | 130.4 | 115.6 | 11.5 | 11.5 | 0.8 | 1.2 |
| 800° F./1 hr | 135.6 | 122.0 | 9.0 | 13.5 | 1.0 | 1.4 |
| 800° F./5 hr | 132.7 | 118.9 | 9.3 | 15.3 | 1.0 | 1.9 |
| 900° F./15 min | 132.4 | 117.8 | 9.0 | 13.9 | 0.9 | 2.1 |
| 900° F./1 hr | 126.5 | 110.8 | 9.5 | 15.1 | 0.9 | 2.8 |
| 900° F./5 hr | 115.9 | 96.0 | 8.5 | 17.0 | 0.7 | 2.7 |
| 15% Cold Work | | | | | | |
| 700° F./15 min | 113.4 | 102.4 | 12.3 | 8.0 | 0.5 | 0.9 |
| 700° F./1 hr | 122.3 | 111.2 | 11.0 | 9.2 | 0.8 | 1.1 |
| 700° F./5 hr | 136.9 | 125.8 | 9.0 | 11.0 | 1.1 | 2.1 |
| 800° F./15 min | 135.8 | 123.8 | 9.8 | 11.5 | 1.1 | 2.9 |
| 800° F./1 hr | 137.1 | 125.1 | 8.8 | 13.3 | 0.7 | 2.2 |
| 800° F./5 hr | 137.6 | 125.1 | 8.3 | 15.8 | 1.0 | 2.3 |
| 900° F./15 min | 130.4 | 118.0 | 7.3 | 14.5 | 1.0 | 2.2 |
| 900° F./1 hr | 123.2 | 108.5 | 7.8 | 15.7 | 1.0 | 2.3 |
| 900° F./5 hr | 116.2 | 97.6 | 7.8 | 17.3 | 1.2 | 3.1 |

TABLE VI

Mechanical Properties Data
Japanese Commercial Cu-3Ti
Advertised Properties

| Temper | UTS (ksi) | YS (ksi) | EL % | IACS % | 180° Bend R/T T | 180° Bend R/T L |
|---|---|---|---|---|---|---|
| ¼ HM | 100–128 | 78–107 | 15–25 | 12–17 | 2.0 | 2.0 |

TABLE VI-continued

| Temper | UTS (ksi) | YS (ksi) | EL % | IACS % | 180° Bend R/T T | 180° Bend R/T L |
|---|---|---|---|---|---|---|
| | Mechanical Properties Data Japanese Commercial Cu-3Ti Advertised Properties | | | | | |
| EHM | 128–156 | 114–142 | 5–15 | 10–15 | 6.0 | Not Listed |
| | Sample Evaluation | | | | | |
| Sample 1 EHM | 146.1 | 132.2 | 11.5 | 12.9 | 2.0 | 7.8 |
| Sample 2 EHM | 143.3 | 129.5 | 8.5 | 11.8 | 1.6 | * |

*Minimum R/T could not be determined with available punches; failed 6.4 R/T.

TABLE VII

| | UTS (ksi) | YS (ksi) | EL % | IACS % | 180° R/T T | 180° R/T L |
|---|---|---|---|---|---|---|
| | Mechanical Properties Data Alloy IV (Cu-3.0 Ti-0.40 Be) | | | | | |
| 0.012" annealed | 71.4 | 41.4 | 18.8 | 5.5 | 0.4 | 1.0 |
| 16.6% CW | 88.3 | 84.3 | 4.3 | 5.6 | 1.4 | 3.1 |
| 16.6% CW & Aged: | | | | | | |
| 900° F./7 hr | 107.3 | 79.6 | 9.7 | 18.9 | 2.0 | 4.7 |
| 900° F./5 hr | 109.3 | 82.4 | 9.7 | 18.3 | 1.6 | 4.7 |
| 900° F./3 hr | 114.6 | 89.3 | 9.1 | 17.7 | 1.8 | 4.7 |
| 900° F./1 hr | 126.7 | 108.5 | 7.3 | 15.8 | 3.1 | 4.7 |
| 900° F./15 min | 138.1 | 124.8 | 7.5 | 13.5 | 3.1 | 4.7 |
| 900° F./5 min | 139.6 | 128.0 | 8.0 | 11.3 | 2.4 | 4.7 |
| 800° F./7 hr | 137.3 | 122.7 | 6.3 | 17.9 | 3.1 | 6.3 |
| 800° F./5 hr | 139.8 | 126.2 | 6.3 | 17.6 | 3.1 | 4.7 |
| 800° F./3 hr | 141.9 | 128.9 | 6.6 | 16.3 | 3.1 | 6.3 |
| 800° F./1 hr | 146.9 | 134.1 | 7.5 | 14.1 | 3.1 | 4.7 |
| 800° F./15 min | 143.5 | 133.2 | 7.8 | 11.8 | 3.1 | 6.3 |
| 800° F./5 min | 122.6 | 115.5 | 8.6 | 8.5 | 2.2 | 4.7 |
| 700° F./7 hr | 150.3 | 141.3 | 5.4 | 14.3 | 3.1 | 6.3 |
| 700° F./5 hr | 150.5 | 140.6 | 6.0 | 13.8 | 4.7 | 6.3 |
| 700° F./3 hr | 147.6 | 137.8 | 6.4 | 12.5 | 3.1 | 6.3 |
| 700° F./1 hr | 136.1 | 127.4 | 8.3 | 10.6 | 3.1 | 4.7 |
| 700° F./15 min | 118.7 | 112.1 | 9.2 | 8.0 | 2.0 | 6.3 |
| 700° F./5 min | 97.6 | 93.3 | 9.1 | 6.1 | 1.8 | 2.4 |

Alloy IV was tested for stress relaxation. For a direct comparison with industry standards, Alloy IV is compared with Alloy 25, the present well-known commercial Cu-Be alloy. Alloy 25 nominally contains about 1.9% beryllium and 0.25% cobalt, balance copper plus normal impurities. The data shown in Table VIII indicates the stress relaxation properties of Alloy IV at 200° C. are essentially similar to the stress relaxation of Alloy 25 at 125° C. which is the generally accepted standard in the art. Therefore, Alloy IV is usable at substantially higher temperatures than Alloy 25.

EXAMPLE V

Alloy V was melted in a graphite crucible and cast in a 1 inch×4 inch×8 inch graphite mold. The slab was overhauled, homogenized 16 hours at 1450° F. and hot rolled to 0.20 inch. Then it was solution annealed; pickled; cold rolled to 0.060 inch, solution annealed, pickled and cold rolled to various ready-to-finish gages; solution annealed; pickled; cold rolled to 0.012 inch; and then received various aging treatments. Table IX presents data obtained from Alloy V cold worked about 11%.

TABLE VIII

| | Temperature °C. | Initial Stress As % Of YS | % Remaining Stress After | | | |
|---|---|---|---|---|---|---|
| | | | 20 Hrs | 115 Hrs | 300 Hrs | 1000 Hrs |
| Alloy IV | 200 | 100 | 85.7 | 86.1 | 80.3 | 77.9 |
| | | 50 | 95.7 | 93.5 | 92.0 | 89.8 |
| | | | 21 Hrs | 87 Hrs | 282 Hrs | 1000 Hrs |
| Alloy 25* | 125 | 100 | 82.2 | 79.2 | — | 74.9 |
| | | 50 | 96.7 | 95.5 | 93.1 | 89.3 |

*Alloy 25 is a commercial alloy. ASTM B 194; AMS 4532.

TABLE IX

| | UTS (ksi) | YS (ksi) | EL % | IACS % | 180° Bend R/T T | 180° Bend R/T L |
|---|---|---|---|---|---|---|
| | Mechanical Properties Data Alloy V (Cu-5.0 Ti-0.42 Be) | | | | | |
| 11% CW | 90.1 | 82.5 | 4.6 | 4.2 | 3.8 | * |
| 11% CW & Aged: | | | | | | |
| 800° F./5 min | 127.5 | 118.4 | 3.0 | 7.0 | 5.1 | * |
| 800° F./3 hr | 146.1 | 134.4 | 2.8 | 11.7 | * | * |
| 900° F./8 hr | 120.9 | 96.7 | 4.0 | 15.5 | 5.0 | * |

*Minimum R/T could not be determined with available punches.

It will be apparent to those skilled in the art that the novel principles of the invention disclosed herein, in connection with specific examples thereof, will support various other modifications and applications of the same. It is accordingly desired that, in construing the breadth of the appended claims, they shall not be limited to the specific examples of the invention described herein.

We claim:

1. A moderate electrical conductivity alloy consisting essentially of, in weight percent, titanium 1.5 to 5.5, beryllium 0.1 to 0.7, aluminum up to 0.75, cobalt plus nickel up to 0.50, total iron, silicon, tin, calcium, lead, zirconium, magnesium and manganese up to 0.70, and the balance copper plus impurities, the ratio of titanium to beryllium being within 5 to 20:1.

2. The alloy of claim 1 wherein titanium is 1.5 to 3.5, beryllium is 0.1 to 0.50, and the ratio of titanium to beryllium is between 8 to 17:1.

3. The alloy of claim 1 wherein titanium is 1.65 to 2.5, beryllium 0.15 to 0.25 and the ratio of titanium to beryllium is between 8 to 17:1.

4. The alloy of claim 1 wherein titanium is about 1.75, beryllium is about 0.175 and the ratio of titanium to beryllium is about 10:1.

5. The alloy of claim 1 wherein titanium is about 2.3, beryllium is about 0.2 and the ratio of titanium to beryllium is about 10:1.

6. The alloy of claim 1 wherein the ratio provides the best combination of mechanical, physical and electrical properties.

* * * * *